430-57 SR
6/23/87 XR 4,675,265

United States Patent [19]
Kazama et al.

[11] Patent Number: 4,675,265
[45] Date of Patent: Jun. 23, 1987

[54] ELECTROPHOTOGRAPHIC LIGHT-SENSITIVE ELEMENT WITH AMORPHOUS C OVERLAYER

[75] Inventors: Toyoki Kazama; Koichi Aizawa; Kiyoto Yamaguchi, all of Kanagawa; Kenichi Hara; Toshiyuki Iijima, both of Nagano, all of Japan

[73] Assignee: Fuji Electric Co., Ltd., Kawasaki, Japan

[21] Appl. No.: 844,003

[22] Filed: Mar. 25, 1986

[30] Foreign Application Priority Data

| | | | |
|---|---|---|---|
| Mar. 26, 1985 | [JP] | Japan | 60-61165 |
| Mar. 28, 1985 | [JP] | Japan | 60-64566 |
| Apr. 30, 1985 | [JP] | Japan | 60-92785 |
| Mar. 28, 1986 | [JP] | Japan | 60-64565 |

[51] Int. Cl.[4] ..... G03G 5/082; G03G 5/14
[52] U.S. Cl. ..... 430/67; 430/57; 430/65; 430/66
[58] Field of Search ..... 430/57, 66, 67

[56] References Cited

U.S. PATENT DOCUMENTS 4,555,464 11/1985 Kido et al. ..... 430/66 X

FOREIGN PATENT DOCUMENTS 60-67955 4/1965 Japan ..... 430/66
57-114146 7/1982 Japan ..... 430/66

*Primary Examiner*—Roland E. Martin
*Attorney, Agent, or Firm*—Brumbaugh, Graves, Donohue & Raymond

[57] ABSTRACT

Electrophotographic light-sensitive elements according to the invention comprise
(a) a conductive support;
(b) a photoconductive layer; and
(c) a surface protective layer.

The conductive support is formed in a sheet-like or cylindrical shape from any suitable conductive material, and acts as an electrode of the light-sensitive element as well as acting as a physical support. The photoconductive layer comprises amorphous hydrogenated silicon having a high absorption efficiency and photoconductivity. The a—Si:H of a photoconductive layer may contain other elements such as fluorine, carbon, nitrogen and germanium, and may be doped with elements belonging to groups III and V of the periodic table. The surface protective layer is the outermost layer of an electrophotographic light-sensitive element according to the invention, and imparts resistance to environmental conditions. The surface protective layer comprises hydrogenated amorphous carbon, and may additionally contain silicon, nitrogen, oxygen or fluorine. The percentage of hydrogen can vary from 1 to 60 mole percent depending upon the conditions under which the surface layer is formed. Preferably, hydrogen is between 10 and 40 mole percent.

23 Claims, 9 Drawing Figures

ELECTROPHOTOGRAPHIC LIGHT-SENSITIVE ELEMENT WITH AMORPHOUS C OVERLAYER

BACKGROUND OF THE INVENTION

The present invention relates to electrophotographic light-sensitive elements.

Previously known electrophotographic light-sensitive elements employed amorphous selenium; photoconductive materials obtained by doping impurities such as arsenic, tellurium, or antimony in, for example, amorphous selenium; or a dispersion of photoconductive materials such as zinc oxide or cadmium sulfide in resin binders. These light-sensitive elements have disadvantageous properties, however, in that they exhibit poor stability to environmental conditions such as temperature and moisture, mechanical stress, or environmental contamination.

In recent years, various techniques for eliminating the problems of these conventional electrophotographic light-sensitive elements have been proposed which use amorphous silicon (a-Si) as the photoconductive material. The a-Si prepared by deposition or sputtering is not desirable as a photoconductive material for electrophotographic light-sensitive elements, since it has a relatively low dark resistivity of $10^5\Omega$-cm and a very low photoconductivity. This is due to the formation of so-called dangling bonds upon cleavage of Si—Si bonds in a-Si prepared by such a process. Because of such defects, many local levels are present within the energy gap, and therefore conduction via thermally excited carriers can occur even when the material is in the dark. Consequently, the dark resistivity is small. Further, upon exposure of the material to light, photoexcited carriers are trapped in the local levels so that photoconductivity is poor.

In amorphous hydrogenated silicon (a-Si:H) prepared by glow discharge decomposition of silane gas ($SiH_4$), the above-described defect is alleviated by the presence of hydrogen atoms bonded to the silicon, and the number of dangling bonds can be greatly reduced thereby. The photoconductivity of such materials is greatly improved, and electron valency of P type and N type can also be controlled. The dark resistivity of these materials, however, is from $10^5$ to $10^9\Omega$-cm at the highest, which is still low when compared to resistivity values of greater than $10^{12}\Omega$-cm required for effective electrophotographic light-sensitive elements. Accordingly, light-sensitive elements comprising a-Si:H have a large dark decay rate of the surface potential and a low initial charge potential.

To impart a charge retention capability to such a-Si:H, the dark resistivity is enhanced to $10^{12}\Omega$-cm or more by doping the a-Si:H with an appropriate amount of boron, paying attention to the above-described fact that electron valency can be controlled. This technique enables utilization of a-Si:H light-sensitive elements in a copying process of the Carlson type.

The light-sensitive elements using boron doped a-Si:H as the surface layer provide good copying images at an initial stage, but often result in poor images when copying is made after they are stored in the air or under high humidity over long periods of time. Further, it is found that repeated copying gradually causes blurring of the images. It is established that such deteriorated light-sensitive elements are liable to produce blurred images at high humidity and, further, that as the number of copies made increases, the critical humidity at which blurring of images occurs tends to become lower.

As described above, the light-sensitive elements having a-Si:H as the surface layer are prone to be affected at the uppermost surface by exposure to the atmosphere or moisture over long periods of time, or by exposure to chemical species (ozone, nitrogen oxides, nascent oxygen, etc.) produced by corona discharge during the copying process. It is thus considered that deterioration in image quality might be caused by a chemical change, but the mechanism of deterioration has not been sufficiently studied so far. In order to prevent the deterioration of image quality and improved printability, a method for achieving chemical stability by providing a protective layer at the surface of the light-sensitive element has been attempted. For example, there is known a method for preventing deterioration of the surface layer of the light-sensitive element due to repetitive copying or environmental conditions which comprises providing a surface protective layer of amorphous hydrogenated carbonated silicon (a-$Si_xC_{1-x}$:H, $0<x<1$) or amorphous nitrogen hydrogenated silicon (a-$Si_xN_{1-x}$:H, $0<x<1$). (Published unexamined Japanese Patent Application No. 115559/82.) These surface layers, however, do not provide resistance to moisture under highly humid conditions for extended periods of time, although printability of the light-sensitive element can be improved to a considerable extent by appropriately choosing the carbon concentration or the nitrogen concentration in the surface protective layer. After copying is repeated several ten thousand times, blurred images still occur at 60% relative humidity or higher. Further, when the amount of carbon is increased in an attempt to enhance the protective function, other problems in characteristics, e.g., increase in residual potential, are caused. Therefore, it is the state of the art that the printability and moisture resistance of light-sensitive elements cannot be greatly improved by providing these surface protective layers while the characteristics of the light-sensitive elements are satisfactorily maintained.

It is an object of the present invention to provide electrophotographic light-sensitive elements having excellent durability, printability, and resistance to moisture, which eliminate the foregoing problems. The light-sensitive elements according to the invention do not exhibit deterioration phenomenon during storage nor in repeated use, and there is little reduction in such characteristics as image quality, even in a highly humid atmosphere. Thus, the electrophotographic light-sensitive elements according to this invention provide stable characteristics as light-sensitive elements and have little restriction upon environments for use.

SUMMARY OF THE INVENTION

Electrophotographic light-sensitive elements according to the invention comprise (a) a conductive support;

(b) a photoconductive layer; and (c) a surface protective layer.

The conductive support is formed in a sheet-like or cylindrical shape from any suitable conductive material, and acts as an electrode of the light-sensitive element as well as acting as a physical support. The photoconductive layer comprises amorphous hydrogenated silicon having a high absorption efficiency and photoconductivity. The a-Si:H of a photoconductive layer may contain other elements such as fluorine, carbon, nitrogen and germanium, and may be doped with elements belonging to groups III and V of the periodic table.

The surface protective layer is the outermost layer of an electrophotographic light-sensitive element according to the invention, and imparts resistance to environmental conditions. The surface protective layer comprises hydrogenated amorphous carbon, and may additionally contain silicon, nitrogen, oxygen or fluorine. The percentage of hydrogen can vary from 1 to 60 atom percent depending upon the conditions under which the surface layer is formed. Preferably, hydrogen is between 10 and 40 atom percent.

Electrophotographic light-sensitive elements according to the invention may also comprise a blocking layer located between the conductive support and the photoconductive layer. The function of the blocking layer is to prevent charge carriers from flowing from the conductive support into the photoconductive layer, and thereby improve the surface charge potential of the light-sensitive element and reduce dark decay. Blocking layers in electrophotographic light-sensitive elements according to the invention may suitably comprise amorphous hydrogenated silicon which is heavily doped with elements belonging to Groups III or V of the periodic table, $Al_2O_3$, AlN, SiO, $SiO_2$, a-$Si_{1-x}C_x$:F,H ($0<x<1$), a-$SiN_x$:H ($0<x<3/4$), a-C:H, fluorinated amorphous carbon; and fluorinated or hydrogenated amorphous carbon having doped therein group III or V elements.

It has also been found that electrophotographic light-sensitive elements according to the invention, with or without a blocking layer, may advantageously include an buffering layer situated between the photoconductive layer and the surface protective layer. The buffering layer is advantageously selected from hydrogenated amorphous silicon carbide, hydrogenated oxygenated amorphous silicon carbide, hydrogenated amorphous silicon nitride, and hydrogenated oxygenated amorphous silicon nitride. Preferably, the concentration of carbon or nitrogen in the buffering layer increases across the thickness of the buffering layer from the photoconductive layer side to the surface protective layer side.

DETAILED DESCRIPTION OF THE INVENTION

Figure 1:
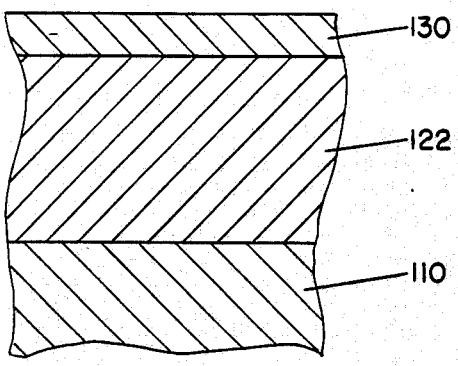
FIG. 1 is a cross-sectional view of an electrophotographic light-sensitive element containing three layers according to the present invention.

The electrophotographic light-sensitive element of the invention will hereinafter be explained in detail with reference to the drawings. An example of the electrophotographic light-sensitive element according to the invention is shown in FIG. 1, in which a photoconductive layer 122 and a surface protective layer 130 are layered on a conductive support 110.

The conductive support can be either a cylindrical or a sheet-like form. It can be made of a metal, such as aluminum or stainless steel, as well as glass or resins with a conductive layer formed thereon.

The photoconductive layer 122 comprise a material having a good absorptivity for the desired light, which at the same time has a high photo-induced electrical conductivity. Examples of such materials include a-Si:H, a-Si:F,H, a-$Si_{1-x}C_x$:H ($0<x<0.3$), a-$SiN_x$:H ($0<x<0.2$), a-$SiO_x$:H ($0<x<0.1$) and a-$Si_{1-x}Ge_x$:H, as well as doped materials prepared by doping these materials with an element belonging to the group III or V of the periodic table. From the practical viewpoint, it is preferable that the layer has a thickness of from 3 to 60 $\mu$m.

The surface protective layer 130 consists of an amorphous film containing carbon and hydrogen atoms (a-C:H). The surface protective layer 130 does not give a sharp image by X-ray or electron diffraction and contains, if any, only a minor proportion of crystallized areas.

The concentration of hydrogen atoms contained in the a-C:H surface layer may vary from 1 to 60 atom percent, depending on the conditions for forming the layer. It is, however, preferable to control the hydrogen concentration of the surface protective layer between 10 and 40 atom percent, and more preferably between 15 and 36 atom percent by appropriately selecting conditions for forming the film. These conditions include the kind of gas used, the power of electric discharge, the rate of gas flow, the gas pressure and the temperature of the base. The a-C:H surface layer preferably has a band gap energy of from 2.0 to 3.2 eV, a refractive index of from 1.5 to 2.8, a resistivity of from $10^8$ to $10^5\Omega$-cm, and a density of not less than 1.3 g/$m^3$.

Figure 2:
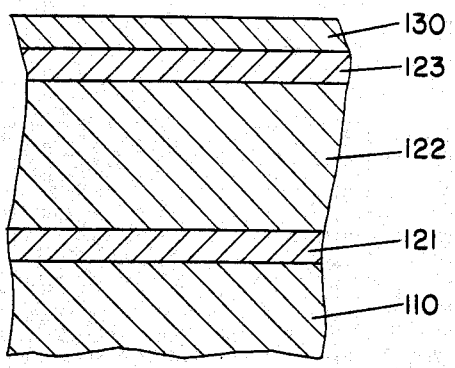
FIG. 2 is a cross-sectional view of an electrophotographic light-sensitive element containing five layers according to the present invention.

Advantageously, the electrophotographic light-sensitive element according to the present invention may include two additional layers. As depicted in FIG. 2, the electrophotographic light-sensitive element may include a blocking layer 121, located between the conductive support 110 and the photoconductive layer 122; and a buffering layer 123, located between the photoconductive layer 122 and the surface protective layer 130. The blocking layer 121, the photoconductive layer 122 and the buffering layer 123 together make up the light-sensitive layer 120.

The function of the blocking layer 121 is to prevent the migration of charge from the conductive layer 110. In the blocking layer 121, there can be used such materials as $Al_2O_3$, AlN, SiO, $SiO_2$, a-$Si_{1-x}C_x$:F,H ($0<x<1$), a-$SiN_x$:H ($0<x<3/4$), a-C:H, fluorinated amorphous carbon (a-C:F), a-C:H or a-C:F doped with an element belonging to group III or V of the periodic table, a-Si:H doped with an element belonging to group III or V of the periodic table, and the like. The thickness of the blocking 121 layer is preferably not greater than 1 μm.

The object of the buffer layer 123 is to ease the differences between the materials contained in the surface layer 130 and in a layer positioned nearer to the base, e.g., the photoconductive layer 122. In the buffer layer, such materials as a-$Si_{1-x}C_x$:H ($0<x<1$), a-$Si_{1-x}C_x$:F,H ($0<x<1$), a-$SiN_x$:H ($0<x<3/4$), a-$SiO_x$:H ($0<x<2$), a-$SiO_x$:F,H ($0<x<2$), and the like can be used. The thickness of the buffer layer 123 can be decided in accordance with the spectral sensitivity, residual voltage, electrical balance with adjacent layers, or the like. In most cases, a thickness not greater than 1 μm is preferable.

It has been found by the inventors that the form of bonding between the hydrogen and carbon atoms is a key factor to decide whether an a-C:H layer can be suitably applied as a surface protective layer to an electrophotographic light-sensitive element. Carbon atoms are known to bond in the diamond structure (coordination number: 4), the graphic structure (coordination number: 3), and the like. An a-C:H film mainly consisting of graphite bonds or polymeric bonds consisting of carbon and hydrogen atoms $(—CH_2—)_n$ has a poor chemical resistant property and an inferior mechanical strength, whereas an a-C:H film mainly consisting of diamond bonds has an excellent chemical resistant property and a superior mechanical strength.

In view of the above facts, the inventors have conducted intensive investigations on the infrared absorption spectrums of hydrogenated amorphous carbons (a-C:H) and their chemical resistance properties and mechanical strength and, as a result, have found that there exists a relationship between the ratio of absorption coefficients of a-C:H films at particular wavelengths and their chemical resistances and mechanical strengths. The present invention has been achieved based on the above finding.

In the present invention, the ratio ($\alpha_2/\alpha_1$), where $\alpha_1$ is the absorption coefficient of the surface protective layer at 2920 $cm^{-1}$ and $\alpha_2$ is the absorption coefficient at 2960 $cm^{-1}$ is preferably not lower than 0.8. Under such circumstances, an a-C:H surface layer which can be applied with advantage as a protective surface layer to the electrophotographic light-sensitive element if formed. The reason why the ratio of absorption coefficients has the above limit has not been theoretically elucidated. It may, however, be presumed that, of the bondings with a coordination number 4, the $CH_3$ type having its absorption peak at 2960 $cm^{-1}$ is stable both mechanically and chemically, whereas the $CH_2$ type having its absorption peak at around 2920 $cm^{-1}$ tends to exist in the polymeric form.

It has been confirmed by many experiments that inferior chemical resistances and mechanical strengths result when the ratio of the absorption coefficients does not fall within the above limit, which supports that it is an indispensable condition that said absorption coefficient ratio is within said limit.

Electrophotographic light-sensitive elements according to this invention can be advantageously made in which the dangling bonds of the amorphous carbon surface protective layer are compensated not only by hydrogen atoms, but also by fluorine, oxygen or nitrogen atoms. For example, hydrogenated amorphous carbon containing oxygen (a-SiC:H,O) can be effectively used as a surface protective layer. The diffraction pattern produced by X-rays or electron rays should be basically unclear, indicating that even if crystalline portions are partly included, their percentage is low. To optimize view of adhesion to the photoconductive layer or a buffering layer, it is desired that the concentration of hydrogen in the surface protective layer be not greater than 40 atom percent. Hydrogen is bound to carbon, whereby absorption at least around 2900 $cm^{-1}$ is present. From a viewpoint of printability, it is desired that the ratio $\alpha_2/\alpha_1$, as defined above, be not less than 0.8.

Oxygen acts to stabilize the dangling bonds of carbon in the same manner as hydrogen. It is desired that the concentration be between 0.1 and 5 atom percent, inclusive.

Study of the characteristics associated with effective surface protective layers for quality electrophotographic light-sensitive elements revealed that, in the absence of a buffering layer, the relative band gap energies of the photoconductive layer and the surface protective layer are important to the formation of an effective device. Accordingly, it is preferred that in electrophotographic light-sensitive elements according to the invention in which there is no buffering layer, the surface protective layer has a band gap energy between 0.2 eV less than the band gap energy of the photoconductive layer and 0.6 eV greater than the band gap energy of the photoconductive layer.

In the electrophotographic light-sensitive elements according to the invention which do include a buffering layer, the buffering layer serves to alleviate any incompatibility between the photoconductive layer and the surface protective layer. In these embodiments, the preferred band gap energy of the surface protective layer is 2.0 eV to 3.2 eV.

Figure 3:
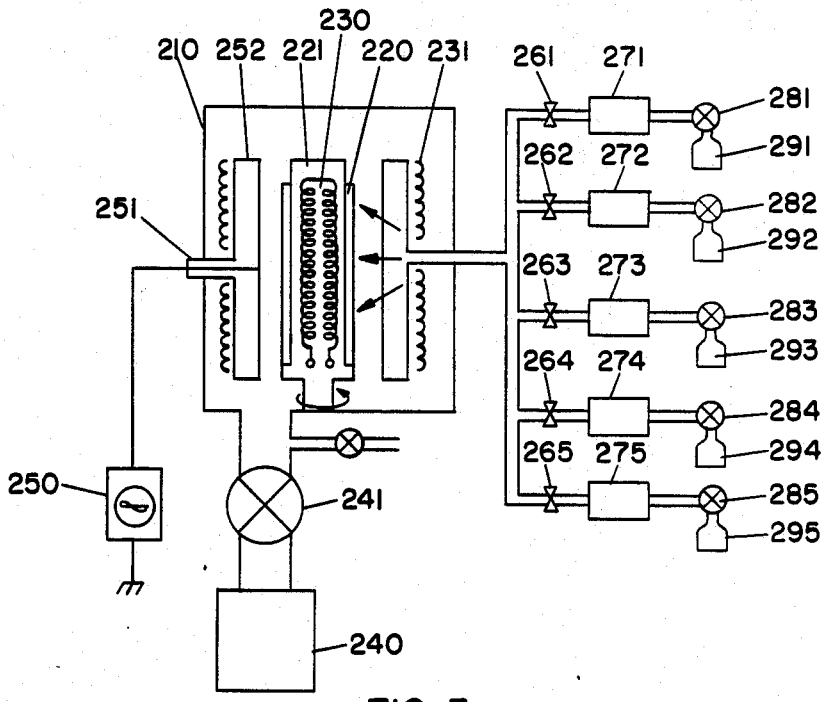
FIG. 3 is a schematic diagram of an apparatus for preparing electrophotographic light-sensitive elements according to the invention.

The process of producing the electrophotographic light-sensitive element according to the invention will be explained with reference to FIG. 3 showing a schematic flow diagram of a manufacturing plant. A conductive support 220 consisting of an aluminum cylinder is placed on a support holder 221 in a vacuum tank 210. The vacuum tank 210 is evacuated to $10^{-6}$ torr through an evacuation valve 241 by means of a vacuum pump. The support 220 is heated to a predetermined temperature, e.g., 50° to 350° C., by means of a heater positioned in the holder 221 and a heater 231 placed in a counter electrode 252. The holder 221 and the support 220 are rotated in order to secure the uniformity, in the peripheral direction, of films to be formed thereon. Various gases necessary for the forming of the above-described layers are stored in pressurized vessels 291 to 295. A raw gas stored in vessel 291 is supplied to the vacuum tank 210 through a valve 281 attached to the vessel, a flow regulator 271 and a stop valve 261. Other gases stored in other tanks are likewise supplied. Thereafter, the pressure in the tank is regulated to a predetermined level, e.g., 0.001 to 5 torr, and glow discharge is allowed to take place between the counter electrode 252 and the support 220 by applying, via an insulator, a high frequency power (e.g., of 13.56 MHz) from a power source 250 to the counter electrode 252 to form a desired film or layer.

In FIG. 3, five sets of pressurized vessels and auxiliary devices are shown, but their number may be decreased or increased depending on the number of gases to be used.

Upon the production of an a-C:H surface layer, the temperature of the base is maintained preferably at a temperature of from 0° to 200° C., more preferably from 50° to 150° C. The energy for the decomposition of unit amount of gas is preferably from 300 to 20,000 J/cc. The gas pressure is preferably from 0.001 to 0.5 torr., more preferably from 0.001 to 0.2 torr. In order to control the quality of films to be formed, an external bias can be applied thereto. In the case of an RF discharge, bias voltage generates automatically. Such a bias, which is generally referred to as "auto-bias," can be from +100 to +500 V or from −100 to −1500 V.

The invention will further be illustrated by the following examples.

EXAMPLE 1

An aluminum cylinder support 220 was degreased and cleaned with trichloroethylene and mounted on the holder 221 in the vacuum tank of the production plant shown in FIG. 3. A blocking layer 121 having a thickness of 0.2 μm was formed on the base under the following conditions:

| | |
|---|---|
| $SiH_4$ (100%) (Flow rate) | 250 cc/min. |
| $B_2H_6$ (5000 ppm based on $H_2$) (Flow rate) | 20 cc/min. |
| Gas pressure | 0.5 torr |
| RF power | 50 W |
| Basic temperature | 200° C. |
| Film-formation time | 10 min. |

A photoconductive layer 122 having a thickness of 25 μm was formed on the blocking layer under the following conditions:

| | |
|---|---|
| $SiH_4$ (100%) (Flow rate) | 200 cc/min. |
| $B_2H_6$ (20 ppm based on $H_2$) (Flow rate) | 10 cc/min. |
| Gas pressure | 1.2 torr |
| RF power | 300 W |
| Basic temperature | 200° C. |
| Film-formation time | 3 hrs. |

A buffering layer 123 having a thickness of 0.1 μm was formed on the photoconductive layer under the follwing conditions:

| | |
|---|---|
| $SiH_4$ (100%) (Flow rate) | 100 cc/min. |
| $CH_4$ (100%) (Flow rate) | 80 cc/min. |
| $B_2H_6$ (2000 ppm based on $H_2$) (Flow rate) | 15 cc/min. |
| Gas pressure | 1.0 torr |
| RF power | 20 W |
| Basic temperature | 200° C. |
| Film-formation time | 2 min. |

A surface protective layer having a thickness of 0.1 μm was then formed on the buffer layer under the following conditions:

| | |
|---|---|
| $C_3H_6$ (100%) (Flow rate) | 20 cc/min. |
| Gas pressure | 0.1 torr |
| RF power | 200 W |
| Basic temperature | 100° C. |
| Film-formation time | 5 min. |

In the above preparation, the basic temperature was measured with an infrared thermometer and a thermoelectric thermometer.

The thus prepared electrophotographic light-sensitive element is designated as Sample 1. The photoconductive layer 122 of Sample 1 had an energy gap of 1.8 eV. The buffering layer 123 had a composition of a-$Si_{0.7}C_{0.3}$:H and an energy gap of 2.1 eV, a density of 1.7 g/cm$^3$, a refractive index of 2.1 and a Knoop hardness of 2000 kgf/mm$^2$. The layer had a hydrogen concentration of 35 atom percent measured by its heat radiation.

Sample 1 was mounted on a plain paper copying machine of Carlson type and 50,000 copies were produced therefrom. The copies had a very sharp image with a high resolution. After the preparation of 50,000 copies, additional copies were produced in an atmosphere of 35° C. and a relative humidity of 85%. Sharp copies were obtained even under such a highly humid condition.

For the purpose of comparison, an electrophotographic light-sensitive element provided with no surface layer was prepared in accordance with the manner described above. This electrophotographic light-sensitive element was mounted on the same copying machine and 50,000 copies were produced therefrom. Thereafter, additional copies were produced in an atmosphere of 35° C. and a relative humidity of 60%. Blurred copies having a lowered resolution were produced.

It is apparent from the above results that the resistance to humidity of the electrophotographic light-sensitive element can be markedly improved by the provision of the surface layer.

Although propylene gas was used for the formation of the surface layer 130 in this example, it is also possible to use other hydrocarbon gases, such as methane, ethane, butane, ethylene, acetylene and benzene gases, as well as a mixture of these gases with hydrogen and/or oxygen.

EXAMPLE 2

Figure 4:
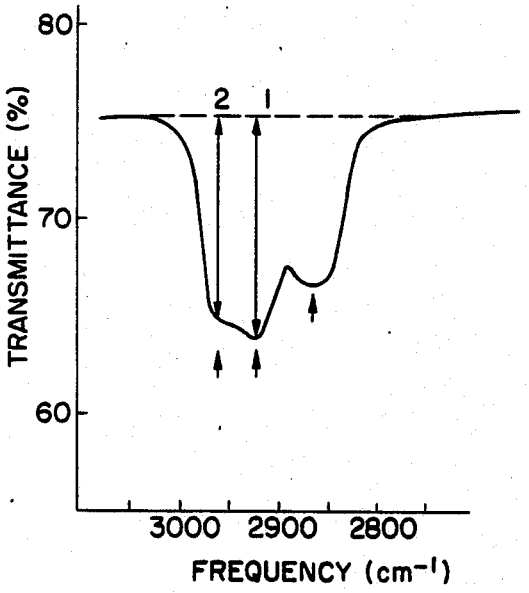
FIG. 4 shows an infrared absorption spectrum of an hydrogenated amorphous carbon surface protective layer according to the invention.

The humidity resistance and the durability of an electrophotographic light-sensitive element is quite substantially influenced by the bonding state between carbon and hydrogen atoms in the a-C:H surface protective layer. The bonding state can be determined from the infrared absorption or reflection spectrum of the surface protective layer. An example of infrared absorption spectrum of an a-C:H surface protective layer is shown in FIG. 4. In the spectrum there can be observed three absorption peaks at 2860 cm$^{-1}$, 2920 cm$^{-1}$ and 2960 cm$^{-1}$. Of these peaks, those at 2920 cm$^{-1}$ and 2960 cm$^{-1}$ are fairly strong and suited for evaluation of the bonding state. In this example, the relationship was examined between such properties as humidity resistance and durability of the electrophotographic light-sensitive element and the ratio ($\alpha_2/\alpha_1$) $\alpha$, being the absorption coefficient at 2920 cm$^{-1}$ and $\alpha_2$ being the absorption coefficient at 2920 cm$^{-1}$.

The process in Example 1 was followed up to the formation of the buffer layer 123 and then 6 different a-C:H layers were formed by varying the kind of gas, the gas pressure and the basic temperature to prepare six different electrophotographic light-sensitive elements (Samples 2–7). The relationship between their $\alpha_2/\alpha_1$ ratio and the humidity resistance and durability of these samples were then assessed.

All of the thus prepared electrophotographic light-sensitive elements, which had $\alpha_2/\alpha_1$ ratios varying from 0.72 to 1.5 as shown in Table 1, gave good images in 50,000 copy tests conducted in the same manner as in Example 1 and showed good durability. Thereafter, additional copies were produced in the same manner as in Example 1 in an atmosphere of 35° C. and a relative humidity of 85%. Results obtained are shown in Table 1.

TABLE 1

| | Sample No. | | | | | |
|---|---|---|---|---|---|---|
| | 2 | 3 | 4 | 5 | 6 | 7 |
| $\alpha_2/\alpha_1$ | 0.72 | 0.76 | 0.84 | 0.90 | 1.1 | 1.5 |
| Humidity Resistance | "C" | "B" | "A" | "A" | "A" | "A" |

In Table 1, and in subsequent Tables, "A" indicates that copies having excellent sharp images were obtained; "B" indicates that copies having slightly inferior images were produced; and "C" indicates that copies having extremely poor images were generated.

It is understood from Table 1 that an electrophotographic light-sensitive element having excellent humidity resistance and durability can be obtained when the ratio $\alpha_2/\alpha_1$ is not less than 0.8.

EXAMPLE 3

In the case where a surface layer is provided on the light-sensitive layer of an electrophotographic light-sensitive element, the adhesion between the surface layer and the adjacent two layer may become a problem. In addition, the discharge of its surface voltage through exposure to light may be hindered by the surface layer, resulting in an increase in its residual voltage.

In this example, the adhesion between the buffer layer and surface layers having various hydrogen concentrations, as well as their residual voltages, were examined.

The process in Example 1 was followed up to the formation of the buffer layer 123, and then eight different kinds of surface layers were formed by varying the kind of gas, the quantity of gas flow, the gas pressure, the RF power and the basic voltage to prepare eight electrophotographic light-sensitive elements with surface layers having different hydrogen concentrations (Samples 8–15).

The relationship between the hydrogen concentration and the adhesion of the surface layers to the buffer layer, as well as their residual voltages, were examined. Results obtained are shown in Table 2, wherein "A" indicates that an excellent adhesion was attained and "C" indicates that an inferior adhesion was resulted.

TABLE 2

| | Sample No. | | | | | | | |
|---|---|---|---|---|---|---|---|---|
| | 8 | 9 | 10 | 11 | 12 | 13 | 14 | 15 |
| Concentration of Hydrogen (atom %) | 6 | 12 | 18 | 32 | 35 | 37 | 41 | 45 |
| Adhesion | "A" | "A" | "A" | "A" | "A" | "A" | "C" | "C" |
| Residual Voltage | 200 | 80 | 25 | 20 | 20 | 40 | 80 | 250 |

The adhesion of the surface layers changes quite sharply at a hydrogen concentration of around 40 atomic percent. A high hydrogen concentration means a reduction in the number of valence states which contribute to the enhancement of adhesion.

When the hydrogen concentration in the a-C:H surface layer is low, it exhibits more diamond-like characteristics and has an increased band gap energy, which causes an undesirable increase in its residual voltage. On the other hand, in the case where its hydrogen concentration is high, the a-C:H surface layer is in a polymeric state having a poor conductivity, which also brings about an undesirably high residual voltage. In view of both the adhesion and residual voltages, the hydrogen concentration in the a-C:H surface layer is preferably from 10 to 40 atom percent, more preferably from 15 to 36 atom percent.

EXAMPLE 4

The process in Example 1 was followed up to the formation of the buffer layer 123, and then six different a-C:H surface layers were formed by varying the time for forming the surface protective layers to prepare six electrophotographic light-sensitive elements which are different in the thickness of their surface protective layers (Samples 16–21). Humidity resistance and other properties of the thus obtained samples were examined. Results obtained are shown in Table 3.

TABLE 3

| | Sample No. | | | | | |
|---|---|---|---|---|---|---|
| | 16 | 17 | 18 | 19 | 20 | 21 |
| Thickness of Film (μm) | 0.001 | 0.005 | 0.1 | 0.5 | 1.0 | 2.0 |
| Residual Voltage (V) | 8 | 8 | 20 | 60 | 100 | 250 |
| Sensitivity (lux-sec) | 0.2 | 0.2 | 0.2 | 0.3 | 0.5 | 1.4 |
| Humidity Resistance | "C" | "A" | "A" | "A" | "A" | "A" |

With regard to Table 3, a larger residual voltage means a smaller S/N ratio. Accordingly, a smaller residual voltage is preferred. Sensitivity is shown in the quantity of exposure required for attenuation to one-half. A smaller quantity of exposure (lux-sec) indicates, therefore, a higher sensitivity. The humidity resistance was judged by the results of copying tests carried out in an atmosphere of a temperature of 35° C. and a relative humidity of 85%, wherein "A" indicates that excellent copies were obtained and "C" indicates that inferior copies were produced. In view of the above results, the thickness of the a-C:H surface layer is preferably from 0.005 to 1 μm.

EXAMPLE 5

A surface protective layer consisting of a-$Si_{1-x}C_x$:H ($0<x<1$) is known. In this example, the humidity resistance of a light-sensitive element with an a-C:H surface layer incorporated with Si was examined in comparison with Sample 1 prepared in Example 1.

The process in Example 1 was followed up to the formation of the buffer layer 123, and then an a-C:H surface layer containing Si was formed thereon under the following conditions:

| | |
|---|---|
| $SiH_4$ (100%) (Flow rate) | 2 cc/min. |
| $C_2H_4$ (100%) (Flow rate) | 20 cc/min. |
| Gas pressure | 0.2 torr. |
| RF power | 300 W |
| Basic temperature | 100° C. |
| Film-formation time | 10 min. |

The above preparation was repeated, varying the rate of the $SiH_4$ flow to prepare a total of three samples (Samples 22 to 24) provided with surface layers containing Si in different quantities. The relationship between their humidity resistance and their compositional ratio Si/C was examined. Results obtained are shown in Table 4. Their humidity resistance was evaluated by copying tests carried out in accordance with the process in Example 4 in an atmosphere of 35° C. and a relative humidity of 85%. In the table, "B" indicates that slightly inferior copies were produced.

TABLE 4

| | Sample No. | | | |
|---|---|---|---|---|
| | 1 | 22 | 23 | 24 |
| Si/C | 0 | 0.08 | 0.15 | 0.22 |
| Humidity Resistance | "A" | "B" | "C" | "C" |

The above results show that the presence of Si in the uppermost layer of an electrophotographic light-sensitive element is undesirable with regard to its influence on humidity resistance. Although pure C is most desirable, the presence of a small quantity of impurities can be permissible. Examples of possible impurities include H, Al, Si, P, As, Cl, F, Fe, Ni, Ti, Mn, Mg, and the like.

EXAMPLE 6

The process in Example 1 was followed up to the formation of the photoconductive layer 122, and then a-C:H surface layers were directly formed thereon, without forming the buffer layer 123. During the formation of the a-C:H film, the kind of gas, the gas pressure, the basic temperature, etc. were varied to prepare 5 different electrophotographic light-sensitive elements provided with a-C:H surface layers having a different energy gaps ($E_g$) (Samples 25–29). The thickness of the surface layers was 0.2 μm.

The thus prepared electrophotographic light-sensitive elements were subjected to copying tests in an atmosphere of 25° C. and a relative humidity of 50%. Results obtained are shown in Table 5.

TABLE 5

| | Sample No. | | | | |
|---|---|---|---|---|---|
| | 25 | 26 | 27 | 28 | 29 |
| $E_g$ in Surface Layer | 2.0 | 2.1 | 2.4 | 2.8 | 3.0 |
| Copying Test | "A" | "A" | "A" | "B" | "C" |

The formation of inferior copies in the above tests is attributable to a discordance in materials used in the surface layer 130 and in the photoconductive layer 122, but not to the humidity of the ambient atmosphere as the relative humidity was as low as 50%. In order to solve this problem, a buffer layer 123 with an intermediate quality is provided between the surface layer 130 and the photoconductive layer 122. Although such a buffer layer may not be required in cases, as is seen in Table 5, where the surface layer has an energy gap ($E_g$) not greater than 2.4 eV. However, it could always be preferable to form a buffer layer in the electrophotographic light-sensitive element according to the present invention, so as to avoid undesirable fluctuation in its quality upon mass production, as well as to prevent an increase in its residual voltage which may be caused by said discordance in materials.

EXAMPLE 7

In a manner similar to example 1, layers up to photoconductive layer 122 were formed. Buffering layer 123 was formed thereon to a thickness of 0.2 μm under the following conditions.

| | |
|---|---|
| Flow amount of $SiH_4$ (100%) | 120 cc/min |
| Flow amount of $NH_4$ (100%) | 30 cc/min |
| Flow amount of $B_2H_6$ ($H_2$ base, 2000 ppm) | 10 cc/min |
| Gaseous pressure | 1.0 Torr |
| RF Electric power | 200 W |
| Support temperature | 200° C. |
| Time for forming layer | 5 mins. |

Surface protective layer 130 was then formed to a thickness of 0.10 μm under the following conditions:

| | |
|---|---|
| Flow amount of $C_3H_8$ (100%) | 20 cc/min |
| Gaseous pressure | 0.1 Torr |
| RF Electric power | 200 W |
| Support temperature | 100° C. |
| Time for forming layer | 5 mins. |

The thus prepared light-sensitive element is designated Sample 10.

The energy gap $E_g$ of photoconductive layer 122 in Sample 30 is 1.8 eV. The buffering layer 123 has a composition of a-$SiN_{0.4}$:H and its $E_g$ is 2.2 eV. The $E_g$ of the surface protective layer is 2.7 eV and, the density of the layer, the refractive index and the Knoop hardness were 1.3 to 1.7 g/cm$^3$, 1.9 to 2.1, and 2000 kgf/mm$^2$, respectively. The concentration of hydrogen calculated from thermal emission was 35 atom percent.

Sample 30 was inserted in an ordinary paper copying machine of Carlson type. After 50,000 copies were made, extremely clear images were obtained at 35° C. under a relative humidity of 85%. Thus, the moisture resistance of the electrophotographic light-sensitive element is substantially improved, as for Sample 1 of Example 1, by providing an a-C:H surface protective layer when the material of the buffering layer is a-$SiN_x$:H ($0<x<1$).

EXAMPLE 8

In a manner similar to Example 1, layers up to photoconductive layer 122 were formed. Buffering layer 123 was formed to a thickness of 0.05 μm under the following conditions.

| | |
|---|---|
| Flow amount of $SiH_4$ (100%) | 75 cc/min |
| Flow amount of $O_2$ (He base, 10%) | 50 cc/min |
| Flow amount of $B_2H_6$ ($H_2$ base, 2000 ppm) | 10 cc/min |
| Gaseous pressure | 0.7 Torr |
| RF Electric power | 200 W |
| Support temperature | 200° C. |
| Time for forming layer | 3 mins. |

The buffering layer 4 is a-$SiO_x$:H wherein x is about 0.1.

An a-C surface protective layer 130 was then formed to a thickness of 0.3 μm under the following conditions:

| | |
|---|---|
| Flow amount of $C_2H_6$ (purity of 99.6%) | 30 cc/min |
| Gaseous pressure | 0.005 Torr |

-continued

| | |
|---|---|
| RF Electric power | 500 W |
| Support temperature | 130° C. |
| Time for forming layer | 20 mins. |

The energy gap $E_g$ of the surface protective layer was around 3.0 eV, but the buffering layer of a-$SiO_x$:H in this example effectively accomplished its function. In image copying test performed in a manner similar to Example 1, clear images were obtained as in Sample 1 of Example 1.

EXAMPLE 9

In a manner similar to Example 1, layers up to photoconductive layer 122 were formed. Buffering layer 123 was formed to a thickness of 0.15 μm under the following conditions:

| | |
|---|---|
| Flow amount of $SiH_4$ (100%) | 50 cc/min |
| Flow amount of $CH_4$ (100%) | 30 cc/min |
| Flow amount of $O_2$ (He base, 10%) | 10 cc/min |
| Flow amount of $B_2H_6$ ($H_2$ base, 2000 ppm) | 5 cc/min |
| Gaseous pressure | 0.7 Torr |
| RF Electric power | 1500 W |
| Support temperature | 200° C. |
| Time for forming layer | 4 mins. |

This buffering layer comprises a-$SiC_xO_y$:H wherein x is 0.3 and y is 0.05. An a-C surface layer 130 was then formed in a manner similar to Example 8.

Image copying test was performed with this light-sensitive element in a manner similar to Example 1; clear images were also obtained.

EXAMPLE 10

In a manner similar to Example 1, seven kinds of light-sensitive elements having a-$Si_{1-x}C_x$:H buffering layers of different layer thicknesses were prepared, by varying time period for layer formation during the formation of buffering layer 123 (Samples 31–36). With these samples, properties as a light-sensitive element were examined and image tests was carried out. Image test was conducted using an ordinary paper copying machine of Carlson type.

The results of the investigation are shown in Table 6.

TABLE 6

| | Sample No. 1 | | | | | | |
|---|---|---|---|---|---|---|---|
| | 31 | 32 | 33 | 34 | 35 | 36 | 37 |
| Layer thickness of buffering layer (μm) | 0.01 | 0.02 | 0.04 | 0.1 | 0.5 | 1.0 | 2.0 |
| Residual potential (V) | 20 | 20 | 20 | 20 | 40 | 60 | 130 |
| Sensitivity (lux-sec) | 0.2 | 0.2 | 0.2 | 0.2 | 0.5 | 1.0 | 3.0 |
| Image test | "C" | "B" | "A" | "A" | "A" | "A" | "A" |

When the buffering layer is too thick, the residual potential becomes large and the sensitivity is lowered. Further, when the buffering layer is too thin, the effect of alleviating incompatibility between surface layer 130 and photoconductive layer 122 is lost and deterioration is observed in the image tests. An appropriate buffering layer thickness is 0.03 to 1.0 μm.

EXAMPLE 11

Figure 5:
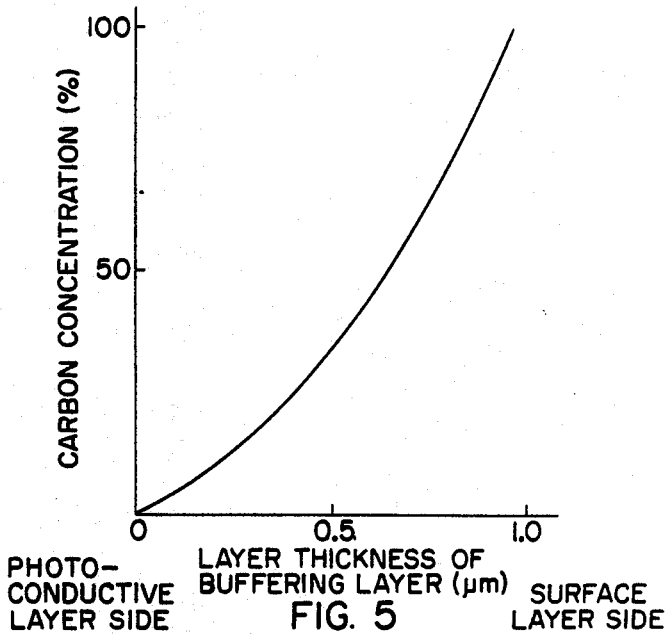
FIG. 5 is a graph of carbon concentration as a function of position in a buffering layer according to the invention.

In Example 10, the carbon concentration of buffering layer 123 throughout the layer was almost uniform but it is not always necessary. Rather, in order to improve the properties of light-sensitive elements, it is effective to have a gradient in the carbon concentration across the thickness of the layer. For example, the layer thickness of buffering layer 123 is set in 1.0 μm and, the carbon concentration can be increased from the photoconductive layer side to the a-C:H surface layer side, as shown in FIG. 5. In FIG. 5, however, only the distribution of the carbon concentration is shown; other elements are omitted.

In such a light-sensitive element, the residual potential is 50 V and the sensitivity is 0.8 lux-sec. No deterioration is observed during image testing. As compared to the case of Example 10 in which the layer thickness was 1.0 μm (Sample 36), the effectiveness is evident.

EXAMPLE 12

Figure 6:
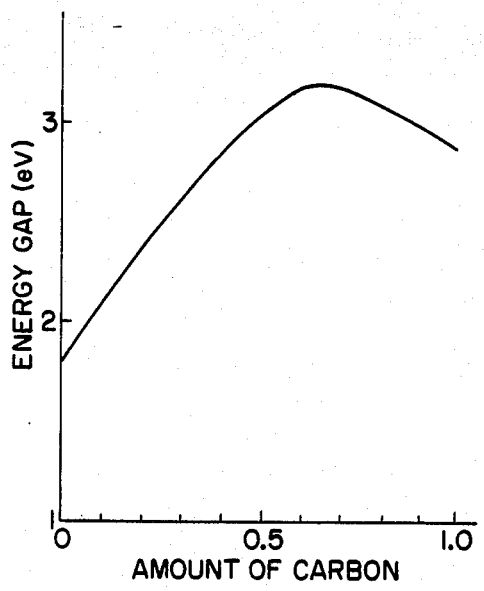
FIG. 6 is a graph of the energy gap of a buffering layer according to the invention as a function of carbon content.

On some occasions, however, it is not the best to choose the graduated carbon concentration of buffering layer 123 as shown in FIG. 5. FIG. 6 shows the relationship between band gap energy $E_g$ of the a-$Si_{1-x}C_x$:H layer formed by a mixture system of $C_2H_4$ and $SiH_4$ and its composition. At the abscissa in FIG. 6, the amount of carbon in a-$Si_{1-x}C_x$:H is expressed as the value of x. As can be seen from FIG. 6, under some circumstances an increase in the carbon concentration does not result in an increase in Eg. Thus a high total carbon concentrations, the carbon concentration distribution as shown in FIG. 5 is not preferred. Instead, it is preferred that electric compatibility with the a-C:H surface layer be attempted by a lower carbon concentration than the composition in which $E_g$ shows the maximum in FIG. 6. The relationship between the value of x showing the carbon amount in a-$Si_{1-x}C_x$:H and the maximum of $E_g$ depends upon conditions for preparation, namely, kind of gas, gaseous pressure, RF electric power, flow amount, etc. but, good compatibility with the a-C:H surface layer is obtained when x is not greater than 0.9, preferably x is not greater than 0.8.

EXAMPLE 13

In a manner similar to Example 7, seven kinds of light-sensitive elements having a-$SiN_x$:H buffering layers of different layer thicknesses were prepared by varying the time period for layer formation during the formation of buffering layer 123 (Samples 38–44). With respect to these samples, properties of light-sensitive elements were examined and image test was performed in a manner similar to Example 10. The results are shown in Table 7.

TABLE 7

| | Sample No. | | | | | | |
|---|---|---|---|---|---|---|---|
| | 38 | 39 | 40 | 41 | 42 | 43 | 44 |
| layer thickness of buffering layer (μm) | 0.02 | 0.04 | 0.06 | 0.1 | 0.5 | 1.0 | 2.0 |
| Residual potential (V) | 20 | 20 | 20 | 20 | 50 | 70 | 150 |
| Sensitivity (lux-sec) | 0.2 | 0.2 | 0.2 | 0.2 | 0.4 | 0.8 | 3.0 |
| Image test | "C" | "B" | "A" | "A" | "A" | "A" | "A" |

As in the case of the a-$Si_{1-x}C_x$:H buffering layer in Example 10, a preferred range is presented in the case of the a-$SiN_x$:H buffering layer an appropriate layer thickness being 0.05 to 1.0 μm.

EXAMPLE 14

As in the case of the a-$Si_{1-x}C_x$:H buffering layer, the nitrogen concentration is not always uniform across the layer thickness direction. In view of properties of light-sensitive elements, it is preferred that the nitrogen concentration have a gradient toward the layer thickness direction.

Figure 7:
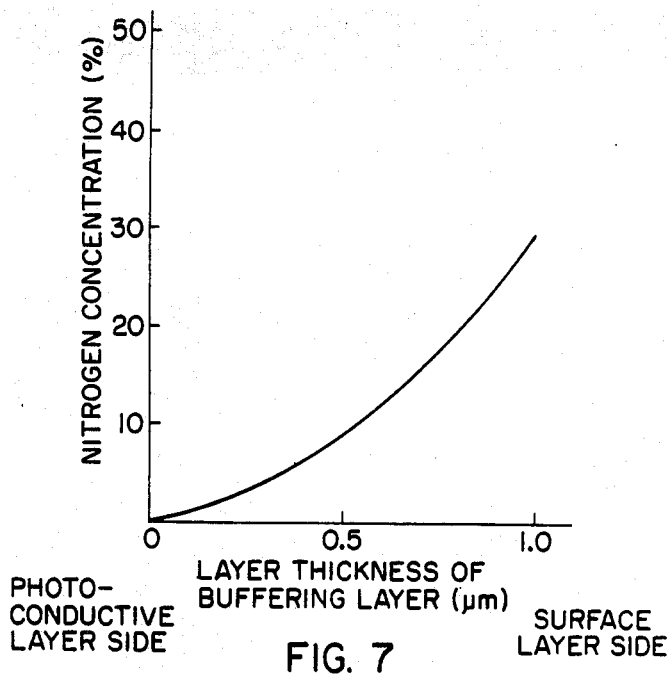
FIG. 7 is a graph of nitrogen concentration as a function of position in a buffering layer according to the invention.

For example, in the light-sensitive element in which the buffering layer thickness is set in 1.0 μm and the nitrogen concentration is increased from the photoconductive layer side to the a-C:H surface layer side as shown in FIG. 7, the residual potential is 50 V, the sensitivity is 0.7 lux-sec and no abnormality is observed in image test. As compared to the case in which the layer thickness of the buffering layer is 1.0 μm in Example 13 (Sample 43), its effectiveness is evident. The vertical axis in FIG. 7 shows the nitrogen concentration in a-$SiN_x$:H, based upon the nitrogen concentration of $SiN_2$ being 100%.

EXAMPLE 15

In the case of the buffering layer composed of a-$SiN_x$:H, it is not preferred to overly increase the nitrogen amount at the outermost surface of the buffering layer. This is because the surface layer is liable to be stripped off from the buffering layer due to weak bond between carbon and nitrogen.

Table 8 shows results upon examination of the composition of the buffering layer at the outermost surface thereof and adhesion to the surface layer. In Table 8, the numerical value appearing in the column designated "Composition" indicates a value of x in a-$SiN_x$:H.

Further in the table, symbols o and x indicate good adhesion and poor adhesion, respectively.

TABLE 8

| | Sample No. | | | | |
|---|---|---|---|---|---|
| | 45 | 46 | 47 | 48 | 49 |
| Composition (x) | 0.2 | 0.4 | 0.8 | 1.0 | 1.3 |
| Adhesion | o | o | o | o | x |

The composition of the buffering layer was measured by ESCA.

It is preferred that the nitrogen concentration be 1 or less by the x value, namely, 50% or less in the case of $SiN_2$.

In the foregoing examples, a-Si type buffering layer containing hydrogen has been described but it may further contain oxygen. That is, a-$Si_{1-x}C_x$:H,O and a-$SiN_x$:H,O are also effective as materials of the buffering layer of the present invention.

EXAMPLE 16

Surface protective layers can also be formed in which oxygen is incorporated with the a-C:H. As an example, an aluminum support 220 which had been greased with trichloroethylene was fixed to holder 221 in a vacuum tank to which $SiH_4$ and $B_2H_4$ were fed as raw gases. A blocking layer 121 having a thickness of 0.2 μm was formed under the following conditions:

| | |
|---|---|
| Flow amount of $SiH_4$ (100%) | 20 cc/min |
| Flow amount of $B_2H_6$ ($H_2$ base, 5000 ppm) | 20 cc/min |
| Gaseous pressure | 0.5 Torr |
| RF electric power | 50 W |
| Support temperature | 200° C. |
| Time for forming layer | 10 mins. |

A photoconductive layer 122 was formed thereon to a thickness of 2.5 μm using $SiH_4$ and $B_2H_6$ as raw gases under the following conditions:

| | |
|---|---|
| Flow amount of $SiH_4$ (100%) | 200 cc/min |
| Flow amount of $B_2H_6$ ($H_2$ base, 20 ppm) | 10 cc/min |
| Gaseous pressure | 1.2 Torr |
| RF electric power | 300 W |
| Time for forming layer | 3 hours |

Buffering layer 123 was then formed thereon to a thickness of 0.1 μm using $SiH_4$, $CH_4$ and $B_2H_6$ as raw gases:

| | |
|---|---|
| Flow amount of $SiH_4$ (100%) | 100 cc/min |
| Flow amount of $CH_4$ (100%) | 80 cc/min |
| Flow amount of $B_2H_6$ ($H_2$ base, 2000 ppm) | 15 cc/min |
| Gaseous pressure | 1.0 Torr |
| RF electric power | 200 W |
| Time for forming layer | 2 mins. |

Lastly thereon, a-C:H,O surface protective layer was formed to a thickness of 0.1 μm under the following conditions:

| | |
|---|---|
| Flow amount of $C_2H_4$ (100%) | 10 cc/min |
| Flow amount of $O_2$ ($H_2$ base, 10%) | 1 cc/min |
| Gaseous pressure | 0.08 Torr |
| RF electric power | 400 W |
| Support temperature | 90–100° C. |
| Time for forming layer | 15 mins. |

The support temperatures were all measured by an infrared thermometer and a thermocouple. The energy gap of surface protective layer, the density of the layer, the refractive index, and the Knoop hardness were 2.6 eV, 1.7 g/cm$^3$, 2.1, and 2000 kgf/mm$^2$, respectively. The concentration of hydrogen calculated from thermal emission was 35 mole percent and the oxygen concentration measured with ESCA and SIMS was 0.5 atom percent.

The light-sensitive element obtained in the above example (Sample 50) was inserted in an ordinary paper copying machine of Carlson type and 100,000 copies were made. Extremely clear images were obtained. Further, images were clear even at 35° C. under a relative humidity of 85%. For purpose of comparison, a light-sensitive element was prepared in a manner similar to the above example except that the surface protective layer was not provided. Copying test was performed using the light-sensitive element. The resolving power of images was decreased at 35° C. under a relative humidity of 60% and blurring in images occurred. It is thus noted that by providing a surface protective layer, moisture resistance is improved.

Such improvement in moisture resistance was also noted when a light-sensitive element in which a-C:H,O surface layer was directly formed on the photoconductive layer without forming a buffering layer was compared with a light-sensitive element in which no other layer is formed on the photoconductive layer.

Next, as a comparative example (Sample 51), a light-sensitive element was prepared by forming layers up to the buffering layer 123 in a manner similar to that given above and then forming a surface protective layer using propane ($C_3H_8$) as a raw gas under the following conditions:

| | |
|---|---|
| Flow amount of $SiH_4$ (100%) | 20 cc/min |
| Flow amount of propane $C_3H_8$ (100%) | 20 cc/min |
| Gaseous pressure | 0.1 Torr |
| RF electric power | 200 W |
| Support temperature | 90–100° C. |
| Time for forming layer | 5 mins. |

The a-C:H surface layer had a layer thickness of 0.1 μm.

Figure 8:
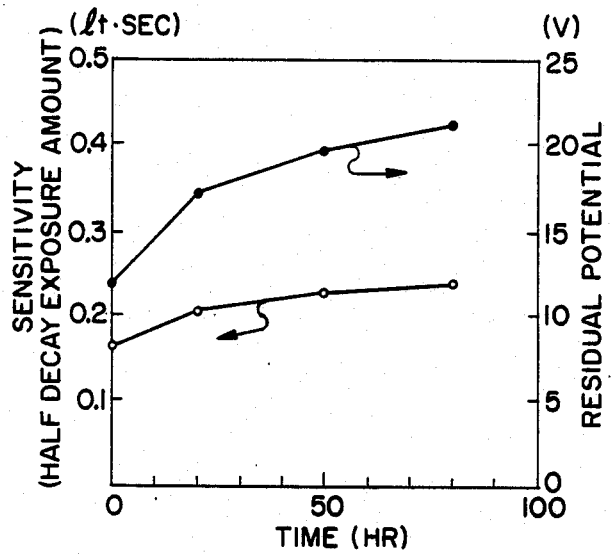
FIG. 8 shows residual potential and sensitivity as a function of time for a comparative electrophotographic light-sensitive element according to example 16, having a surface protective layer containing Si and C.
Figure 9:
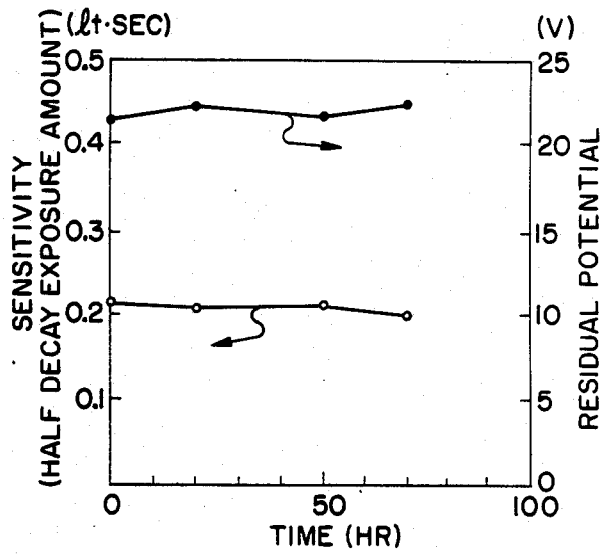
FIG. 9 shows residual potential and sensitivity as a function of time for an electrophotographic light-sensitive element according to the invention having a surface protective layer of a-C:H,O.

FIGS. 8 and 9 show the change in properties of light-sensitive elements with passage of time; FIG. 8 showing the comparative Sample 51 and FIG. 9 shows Sample 50. Stability of properties of the light-sensitive element is improved by incorporating oxygen in the surface layer.

It is assumed from analytical results that the change in properties of Sample 51 with passage of time would be due to oxidation of the a-C:H surface layer or a layer adjacent thereto and, this oxidation is accelerated by oxygen or moisture in the air or, ozone, $NO_x$: etc. generated during copying process.

It is also effective to incorporate oxygen in the a-C surface layer from a viewpoint of improving charging ability. In the comparative example, the charge potential was 430 V, whereas it increased to 560 V when no oxygen was incorporated. Further the incorporation of oxygen in an appropriate concentration is also effective to enhance adhesion of layers, mechanical strength, chemical stability and printability.

The appropriate oxygen concentration ranges from 0.1 to 5 atomic percent, inclusive. With a concentration lower than 0.1 atomic percent, the effect of the incorporation is poor and, with a concentration exceeding 5 atomic percent, the quality of a layer is deteriorated, voids increase, and moisture resistance is less.

Hydrocarbons useful for forming the a-C:H,O layer include gases, such as $CH_4$, $C_2H_6$, $C_4H_{10}$, $C_2H_2$, $C_6H_6$, etc. and a gaseous mixture of these gases with hydrogen, in addition to $C_2H_4$ and $C_3H_5$. To incorporate oxygen, $CO_2$, CO, $NO_2$, $H_2O$, etc. can also be employed, in addition to $O_2$. Nitrogen in almost the same amount as that of oxygen is also incorporated where a raw material also containing nitrogen is used.

EXAMPLE 17

A four layer electrophotographic light-sensitive element, consisting of a conductive support, a blocking layer, a conductive layer and a surface protective layer was formed in an apparatus such as that depicted in FIG. 2. The blocking layer, having a thickness of 0.2 μm was formed on the conductive support under the following conditions:

| | |
|---|---|
| Flow amount of $SiH_4$ (100%) | 250 cc/min |
| Flow amount of $B_2H_6$ ($H_2$ base, 5000 ppm) | 20 cc/min |
| Gaseous pressure | 0.5 Torr |
| RF Electric power | 50 W |
| Support temperature | 200° C. |
| Time for forming layer | 10 mins. |

A photoconductive layer was formed to a thickness of 2.5 μm using $SiH_4$ and $B_2H_6$ as raw gases under the following conditions:

| | |
|---|---|
| Flow amount of $SiH_4$ (100%) | 200 cc/min |
| Flow amount of $B_2H_6$ ($H_2$ base, 20 ppm) | 10 cc/min |
| Gaseous pressure | 1.2 Torr |
| RF electric power | 300 W |
| Time for forming layer | 3 hours |

Lastly thereon, a-C surface protective layer was formed in a thickness of 0.1 μm using $CH_4$ as a raw gas under the following conditions:

| | |
|---|---|
| Flow amount of $CH_4$ (100%) | 20 cc/min |
| Gaseous pressure | 0.03 Torr |
| RF Electric power | 200 W |
| Support temperature | 90–100° C. |
| Time for forming layer | 5 mins. |

The support temperature was measured by an infrared thermometer and a thermocouple.

The light-sensitive element is designated Sample 52. The energy gap $E_g$ of photoconductive layer 3 in Sample 52 is 1.8 eV. Further $E_g$ of the surface protective layer is 2.3 eV and, the density of the layer, the refractive index and the Knoop hardness were 2.3 eV, 1.8 g/cm$^3$, 2.3 and 2200 kgf/mm$^2$, respectively. The concentration of hydrogen calculated from thermal emission was 33 atom percent. Sample 30 was inserted in an ordinary paper copying machine of Carlson type and 100,000 copies were made. Extremely clear images were obtained. Further, images were clear even at 35° C. under a relative humidity of 85%.

For purpose of comparison, a light-sensitive element was prepared in a manner similar to the above example except that the surface protective layer was omitted. Copying test was performed using the light-sensitive element. The resolving power of images was decreased at 35° C. under a relative humidity of 60% and blurring in images occurred. It is thus noted that by providing the surface layer, moisture resistance is improved.

EXAMPLE 18

In a manner similar to Example 17, layers up to the photoconductive layer were formed and surface protective layers comprising a-C:H having different $E_g$ values were formed thereon to examine adaptability as a light-sensitive element. The results are shown in Table 9. The thickness of the surface protective layer was approximately 0.1 μm. $E_g$ values of the surface protective layer can be varied depending upon conditions for forming a layer, namely, raw gas, RF electric power, flow amount of gas, gaseous pressure, support temperature, etc.

TABLE 9

| Sample | $E_g$ of Surface Layer (eV) | Residual Potential (V) | Half Decay Exposure Amount (lux-sec) | Image Test |
|---|---|---|---|---|
| 52 | 1.4 | — | — | "C" |
| 53 | 1.6 | 10 | 0.2 | "A" |
| 54 | 1.8 | 10 | 0.2 | "A" |
| 55 | 2.0 | 20 | 0.2 | "A" |
| 56 | 2.1 | 20 | 0.2 | "A" |
| 57 | 2.4 | 20 | 0.2 | "A" |
| 58 | 2.8 | 100 | 0.6 | "B" |
| 59 | 3.0 | 200 | 1.3 | "C" |

Image tests were conducted using a copying machine at 25° C. in an atmosphere having a relative humidity of 50%. Accordingly, poor images in the high $E_g$ region are not due to moisture, but are caused by incompatibility in materials between the surface protective layer and the photoconductive layer. Further poor images in a low $E_g$ region are caused because the resistance of the surface protective layer decreases so that a potential is only applied to the surface with difficulty, resulting in decrease of an S/N ratio. The photoconductive layer having an $E_g$ of 1.8 eV shows a good electrical compatibility with a surface protective layer having an $E_g$ of 2.4 eV.

EXAMPLE 19

In a manner similar to Example 17, a blocking layer was prepared and a photoconductive layer was formed thereon under the following conditions:

| | |
|---|---|
| Flow amount of $SiH_4$ (100%) | 200 cc/min |
| Flow amount of propane $B_2H_6$ ($H_2$ base, 20 ppm) | 100 cc/min |
| Gaseous pressure | 1.2 Torr |
| RF Electric power | 300 W |
| Support temperature | 200° C. |
| Time for forming layer | 3 hours. |

The photoconductive layer had $E_g$ of 1.6 eV. Various a-C surface layers having different $E_g$ values were formed thereon in a manner similar to Example 18 to examine adaptability as a light-sensitive element. The results are shown in Table 10. The thickness of the surface layer was about 0.1 μm.

TABLE 10

| Sample | $E_g$ of Surface Layer (eV) | Residual Potential (V) | Half Decay Exposure Amount (lux-sec) | Image Test |
|---|---|---|---|---|
| 60 | 1.2 | — | — | "C" |
| 61 | 1.4 | 8 | 0.2 | "A" |
| 62 | 1.6 | 8 | 0.2 | "A" |
| 63 | 1.8 | 15 | 0.2 | "A" |
| 64 | 2.0 | 15 | 0.2 | "A" |
| 65 | 2.2 | 15 | 0.2 | "A" |
| 66 | 2.6 | 80 | 0.6 | "B" |
| 67 | 2.8 | 150 | 1.3 | "C" |

The photoconductive layer having an $E_g$ of 1.6 eV shows a good electrical compatibility with surface protection layers having an $E_g$ of 1.4 eV−2.2 eV.

EXAMPLE 20

In a manner similar to Examples 18 and 19, compatibility between each of photoconductive layers having different $E_g$ values and the surface protective layer was examined. The results are shown in Table 11.

TABLE 11

| $E_g$ of Surface Layer (eV) | $E_g$ of Photoconductive Layer 1.6 | 1.7 | 1.8 | 1.9 |
|---|---|---|---|---|
| 1.3 | X | X | X | X |
| 1.4 | O | X | X | X |
| 1.5 | O | O | X | X |
| 1.6 | O | O | O | X |
| 1.7 | O | O | O | O |
| 2.0 | O | O | O | O |
| 2.2 | O | O | O | O |
| 2.3 | X | O | O | O |
| 2.4 | X | X | O | O |
| 2.5 | X | X | X | O |
| 2.6 | X | X | X | X |

In the table, symbol o indicates that residual potential, sensitivity and moisture resistance are all good and, symbol x indicates that the foregoing properties are questionable from a viewpoint of practical use. From the table, it is understood that a preferred range for $E_g$ of the surface protective layer to $E_g$ of photoconductive layer 3 is in a relation: ($E_g$ of photoconductivity layer −0.2 eV)≦($E_g$ of surface layer)≦($E_g$ of photoconductive layer 0.6 eV).

EXAMPLE 21

In a manner similar to Example 18, layers up to the photoconductive layer were formed and various a-C:H surface protective layers having different refractive indices n were formed thereon, to examine adaptability as a light-sensitive element. The results are shown in Table 12. The layer thickness of the surface layer formed in this case was about 0.2 μm.

TABLE 12

| n | 1.3 | 1.5 | 1.7 | 2.0 | 2.3 | 2.6 | 2.8 | 3.0 |
|---|---|---|---|---|---|---|---|---|
| Image Test | C | B | A | A | A | A | A | C |

The results were obtained by forming images at 35° C. under a relative humidity of 85% after 10,000 copies were made. Poor images at high n values was caused because an insufficient amount of light reached the photoconductive layer.

In order to sufficiently exhibit the function of surface layer as a surface protective layer, a range of $1.7 \leqq n \leqq 2.8$ is desired, as is noted from Table 12. This is believed to be because chemical resistance and mechanical strength of the a-C layer are excellent in this range. The configuration of bond between the hydrogen atom and the carbon atom contained in the a-C surface layer reflects a binding state among carbon atoms and, is one of important factors which affect adaptability of the formed a-C layer as a surface layer of an electrophotographic light-sensitive element. As the binding state among carbon atoms, there are a diamond bond (four-coordination), a graphite bond (three-coordination), etc. It is known that the a-C layer mainly composed of the graphite bond or a polymer-like bond $(—CH_2—)_2$ comprising carbon and hydrogen is inferior in chemical resistance and mechanical strength. On the other hand, it is reported that the a-C layer mainly composed of the diamond bond is markedly superior in chemical resistance and mechanical strength. It is assumed that when n is small, a-C takes a polymer-like structure so that the layer is inferior in chemical resistance and mechanical strength; when n is relatively large, a-C takes a diamond-like structure of that the surface protective layer could have excellent printability. However, when n is excessively large, a light transmittance decreases so that an amount of light to reach photoconductive layer 3 decreases, which is not preferred.

EXAMPLE 22

In a manner similar to Example 1, layers up to the buffering layer were formed and various a-C:H layers having different $E_g$ values ranging from 2.0 to 3.4 eV were formed thereon to examine adaptability as a light-sensitive element. $E_g$ of the buffering layer was 2.2 eV, for example, to 2.6 eV of $E_g$ for the surface layer; when $E_g$ of the surface layer was 3.0 eV, the reaction tank comprised of two layers of 2.2 eV and 2.6 eV. The results of evaluation are shown in Table 13. The effect of moisture resistance on image formation was judged in an atmosphere showing a relative humidity of 85%.

TABLE 13

| $E_g$ of surface layer (eV) | 2.0 | 2.2 | 2.4 | 2.8 | 3.0 | 3.2 | 3.4 |
|---|---|---|---|---|---|---|---|
| Residual potential (V) | 30 | 30 | 30 | 40 | 30 | 150 | 250 |
| Moisture resistance | o | Δ | Δ | Δ | Δ | Δ | Δ |

In the table, symbol Δ shows that clear images were obtained and symbol o shows that images of no problem in practical use were obtained.

When $E_g$ of the surface layer is 2.0 eV or more, moisture resistance is good. However, when $E_g$ of the surface layer increases, the residual potential markedly increases while deterioration in images does not occur by laminating a plurality of buffering layers. A preferred range is between 2.2 and 3.2 eV.

EXAMPLE 23

In a manner similar to Example 1, layers up to the photoconductive layer were prepared. Next, the buffering layer was formed to a thickness of 0.05 μm under the following conditions:

| | |
|---|---|
| Flow amount of $SiH_4$ (100%) | 75 cc/min |
| Flow amount of $O_2$ ($H_2$ base, 10%) | 50 cc/min |
| Flow amount of $B_2H_6$ ($H_2$ base, 2000 ppm) | 10 cc/min |
| Gaseous pressure | 1.77 Torr |
| RF Electric power | 200 W |
| Time for forming layer | 3 mins. |

The buffering layer is a-$Si_{1-x}O_x$:H wherein x is about 0.1.

Further thereon, a-C surface layer was formed in a thickness of 0.3 μm under the following conditions:

| | |
|---|---|
| Flow amount of $C_2H_6$ (purity of 99.6%) | 10 cc/min |
| Gaseous pressure | 0.008 Torr |
| RF Electric power | 500 W |
| Support temperature | 130° C. |
| Time for forming layer | 20 mins. |

The surface protective layer had $E_g$ of 3.0 eV and clear images were obtained in the test.

EXAMPLE 24

In a manner similar to Example 1, layers up to the photoconductive layer were formed and the buffering layer was formed in a thickness of 0.2 μm under the following conditions:

| | |
|---|---|
| Flow amount of $SiH_4$ (100%) | 120 cc/min |
| Flow amount of $NH_4$ (100%) | 30 cc/min |
| Flow amount of $B_2H_6$ ($H_2$ base, 2000 ppm) | 10 cc/min |
| Gaseous pressure | 1.0 Torr |
| RF Electric power | 200 W |
| Time for forming layer | 5 mins. |

This buffering layer comprises a-$SiN_x$:H and x is 0.4. Further thereon, a-C a surface protective layer was formed to a thickness of 0.1 μm in a manner similar to Example 1.

The surface layer showed $E_g$ of 2.7 eV and clear images were obtained in image tests.

EXAMPLE 25

In a manner similar to Example 1, layers up to the photoconductive layer were formed. Next, the buffering layer was formed in a thickness of 0.15 μm under the following conditions:

| | |
|---|---|
| Flow amount of $SiH_4$ (100%) | 50 cc/min |
| Flow amount of $CH_4$ (100%) | 50 cc/min |
| Flow amount of $O_2$ ($H_2$ base, 10%) | 10 cc/min |
| Flow amount of $B_2H_6$ ($H_2$ base, 2000 ppm) | 5 cc/min |
| Gaseous pressure | 0.7 Torr |
| RF Electric power | 150 W |
| Time for forming layer | 4 mins. |

This buffering layer comprises a-$Si_{1-x}CO_y$:H wherein x is 0.3 and y is 0.05.

Further thereon, a-C surface layer was formed under conditions similar to Example 20, and clear images could be obtained.

In addition to the foregoing examples, light-sensitive elements of no problem in practical use were obtained by appropriately choosing $E_g$ of surface layer, using a-$Si_{1-x}C_x$:F,H, a-$SiO_x$:F,H or a-$SiN_x$:F,H as the buffering layer.

We claim:

1. An electrophotographic light-sensitive element comprising a conductive support having provided thereon in sequence:
   (a) a photoconductive layer comprising amorphous silicon; and
   (b) a surface protective layer comprising hydrogenated amorphous carbon, wherein the concentration of hydrogen atoms in the surface protective layer is from 1 atom percent to 60 atom percent; wherein said amorphous carbon is mainly bonded in a four-coordinate diamond structure such that the surface protective layer is chemically resistant and has good mechanical strength, and wherein said surface protective layer has a thickness sufficient to provide humidity resistance but not so great as to result in a significant loss of sensitivity.

2. An electrophotographic light-sensitive element according to claim 1, wherein the surface protective layer comprises hydrogenated amorphous carbon containing from 10 to 40 atom percent hydrogen.

3. An electrophotographic light-sensitive element according to claim 2, wherein the amorphous carbon contains from 15 to 36 atom percent hydrogen.

4. An electrophotographic light-sensitive element according to claim 2, wherein $\alpha_2/\alpha_1$, is greater than 0.8, $\alpha_1$ being the absorption coefficient of the surface layer at 2920 $cm^{-1}$, and $\alpha_2$ being the absorption coefficient of the surface protective layer at 2960 $cm^{-1}$.

5. An electrophotographic light-sensitive element according to claim 2, wherein the surface layer has a thickness of from 0.005 to 1.0 μm.

6. An electrophotographic light-sensitive element according to claim 2 further comprising a buffering layer, said buffering layer comprising amorphous silicon and being located between the photoconductive layer and the surface protective layer.

7. An electrophotographic light-sensitive element according to claim 6, wherein the amorphous carbon of the surface protective layer contains from 15 to 36 atom percent hydrogen.

8. An electrophotographic light-sensitive element according to claim 6, wherein the buffering layer is selected from hydrogenated amorphous silicon carbide and hydrogenated oxygenated amorphous silicon carbide.

9. An electrophotographic light-sensitive element according to claim 8, wherein the carbon concentration of the buffering layer increases from the photoconductive layer side to the surface protective layer side.

10. An electrophotographic light-sensitive element according to claim 8, wherein the buffering layer has a thickness of from 0.03 to 1 μm.

11. An electrophotographic light-sensitive element according to claim 6, wherein the buffering layer is selected from hydrogenated amorphous silicon nitride and hydrogenated oxygenated amorphous silicon nitride.

12. An electrophotographic light-sensitive element according to claim 11, wherein the nitrogen concentration of the buffering layer increases from the photoconductive layer side to the surface protective layer side.

13. An electrophotographic light-sensitive element according to claim 11, wherein the thickness of the buffering layer is from 0.05 to 1.0 μm.

14. An electrophotographic light-sensitive element according to claim 6, wherein the buffering layer comprises hydrogenated amorphous silicon oxide.

15. An electrophotographic light-sensitive element according to claim 6, wherein the buffering layer comprises hydrogenated amorphous silicon oxide carbide.

16. An electrophotographic light-sensitive element according to claim 1, wherein the surface protective layer comprises hydrogenated amorphous carbon containing oxygen.

17. An electrophotographic light-sensitive element according to claim 16, wherein the surface protective layer comprises less than 40 atom percent hydrogen.

18. An electrophotographic light-sensitive element according to claim 16, wherein the surface protective layer contains from 0.1 to 5 atom percent oxygen.

19. An electrophotographic light-sensitive element according to claim 1, wherein the surface protective layer is selected such that the band gap energy of the surface protective layer is between 0.2 eV lower than the band gap energy of the photoconductive layer and 0.6 eV higher than the band gap energy of the photoconductive layer.

20. An electrophotographic light-sensitive element according to claim 19, wherein the surface protective layer has a refractive index of from 1.7 to 2.8.

21. An electrophotographic light-sensitive element according to claim 6, wherein the surface protective layer has a band gap energy of from 2.0 eV to 3.2 eV.

22. An electrophotographic light-sensitive element according to claim 21, wherein the surface protective layer has a refractive index of from 1.7 to 2.8.

23. An electrophotographic light-sensitive element according to any one of claims 1, 2, 6, 16, 19 and 21 further comprising a blocking layer located between the conductive support and the photoconductive layer.

* * * * *